US006702597B2

(12) United States Patent
Pade

(10) Patent No.: US 6,702,597 B2
(45) Date of Patent: Mar. 9, 2004

(54) CABLE HARNESS PLUG HAVING A LOCKING SLIDE AND A PRELOCK

(75) Inventor: Wolfgang Pade, Illingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/921,033

(22) Filed: Aug. 2, 2001

(65) Prior Publication Data

US 2002/0072261 A1 Jun. 13, 2002

(51) Int. Cl.[7] ..... H01R 13/62

(52) U.S. Cl. ..... 439/157; 439/247; 439/347; 439/545

(58) Field of Search ..... 439/157, 345, 439/352, 341, 342, 347, 545, 247

(56) References Cited

U.S. PATENT DOCUMENTS 5,833,484 A * 11/1998 Post et al. ..... 439/352
6,168,445 B1 * 1/2001 Seutschniker et al. ..... 439/157
6,213,795 B1 * 4/2001 Dresscher et al. ..... 439/157
6,254,407 B1 * 7/2001 Burns ..... 439/157
6,305,957 B1 * 10/2001 Fink et al. ..... 439/157
6,345,995 B1 * 2/2002 Bigotto et al. ..... 439/157

* cited by examiner

*Primary Examiner*—Truc Nguyen
(74) *Attorney, Agent, or Firm*—Kenyon & Kenyon

(57) ABSTRACT

An electric plug-and-socket connection, including a first plug part, in particular a cable harness plug, having a locking slide which can be moved from an initial position into an end position and having another plug part into which the first plug part can be inserted to establish an electric plug-and-socket connection. To prevent the locking slide from assuming its end position before being connected to the other plug part, latching elements provided on the side of the first plug part work together with the locking slide so that they latch with the locking slide in its initial position. By connecting to the other plug part, pins engage in the latching elements in such a way that the latching elements are disengaged and the locking slide can be brought into its end position after connecting the first plug part.

6 Claims, 4 Drawing Sheets

CABLE HARNESS PLUG HAVING A LOCKING SLIDE AND A PRELOCK

FIELD OF THE INVENTION

The present invention relates to an electric plug-and-socket connection, including a first plug part, in particular a cable harness plug, having a locking slide which can be moved from an initial position into an end position and having another plug part into which the first plug part can be inserted to establish an electric plug-and-socket connection.

BACKGROUND INFORMATION

Disconnectable plug-and-socket connections of the type mentioned above are known in a variety of versions. As a rule, they include a first plug part, e.g., a cable harness plug, and another plug part, e.g., a male connector. The first plug part is designed so that it has either a locking claw or a locking slide or it may have both a locking claw and a locking slide which work together with the other plug part so that a friction-locked connection is formed between the two plug parts. This guarantees that unintentional disconnection of the plug-and-socket connection due to vibration stresses, for example, is prevented.

When assembling the first plug part on the other plug part, it has been found that the locking slide has often already assumed its end position, which is why it is necessary with several additional manipulations to first bring the locking slide into its initial position, to also position a locking claw, if present, accordingly and then to place it accurately on a male connector, paying attention to the fact that the locking slide retains its initial position.

SUMMARY OF THE INVENTION

Because of this very complicated manipulation to establish the plug-and-socket connection, an object of the present invention is to provide a disconnectable plug-and-socket connection having a locking slide such that the locking slide is prevented from unintentionally being shifted into its locking position before the first plug part is plugged onto the other plug part.

This object is achieved by the fact that latching elements are provided on the first plug part, which latch with the locking slide in its initial position, and they release the locking slide after connection to the other plug part.

A main advantage of the present invention is that the plug-and-socket connection can be established very easily without the locking slide and, if present, the locking claw already sliding into their end position even before the plug-and-socket connection is established, thus possibly preventing a correct connection.

To maintain and guarantee the initial position of the locking slide before the connection operation, latching elements are arranged on the side of the housing of the first plug part. These latching elements are preferably designed as latching hooks hinge-connected to the housing, with the latching hooks themselves engaging in the locking slide provided the slide has assumed its initial position. This guarantees in an advantageous manner that the locking slide cannot slip out, especially in transport of the first plug part, thus possibly becoming lost, and also that a simple connection with another plug part is possible.

To undo the latching, the first plug part is placed on the other plug part. The latching pins arranged on the other plug part engage behind the latching elements of the first plug part and disengage it, so that if the first plug part is connected to the other plug part, the locking slide then can be brought into its end position.

In another embodiment, a locking claw is also arranged on the first plug part. This locking claw works together with the locking slide in such a way that it can be swivelled only when the locking slide is in its end position.

On reaching the inserted position of the first plug part in the second plug part, a cam element provided on the second plug part presses the locking pawl from the locking element so that the locking pawl is now disengaged and thus enables the retaining ring to slide. On reaching this end position, the latching hook then latches with the other plug part.

DETAILED DESCRIPTION

Figure 1:
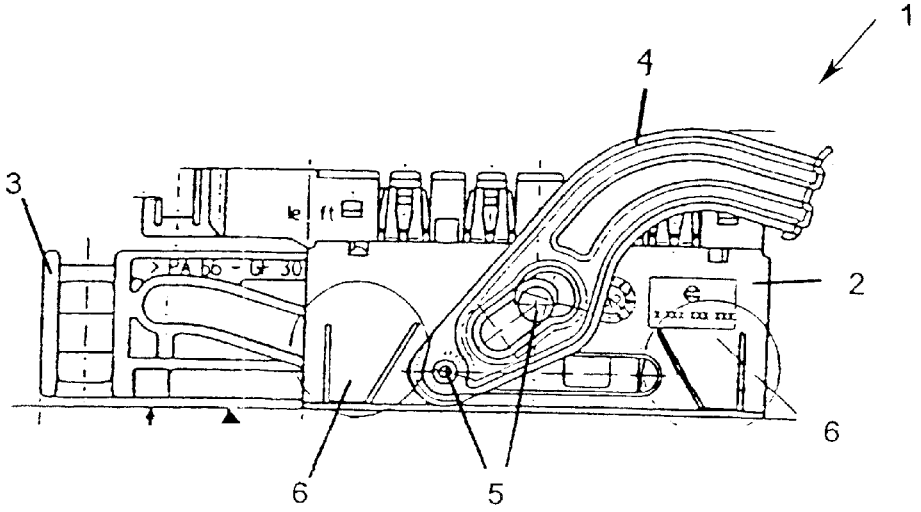
FIG. 1 shows a side view of a first plug part of a disconnectable plug-and-socket connection having the locking slide and the corresponding latching elements.

FIG. 1 shows plug part 1 of the plug-and-socket connection according to the present invention. It includes a plug housing 2 and a locking slide 3 arranged on plug housing 2 such that it is displaceably mounted in the housing. In the embodiment illustrated in the figures, a locking claw 4 is also provided on plug housing 2. Locking claw 4 is connected to locking slide 3 by a coupling element 5. This exercises its function in such a way that in the starting position of locking slide 3 illustrated in FIG. 1, locking claw 4 cannot be brought from the starting position, which is also illustrated in FIG. 1, to an end position. The end position cannot be reached until locking slide 3 has been inserted completely.

Latching elements 6 according to the present invention are arranged on the outside of plug housing 2. In the embodiment illustrated in the figures, two latching elements 6 are provided on both side faces of plug housing 2.

Figure 2:
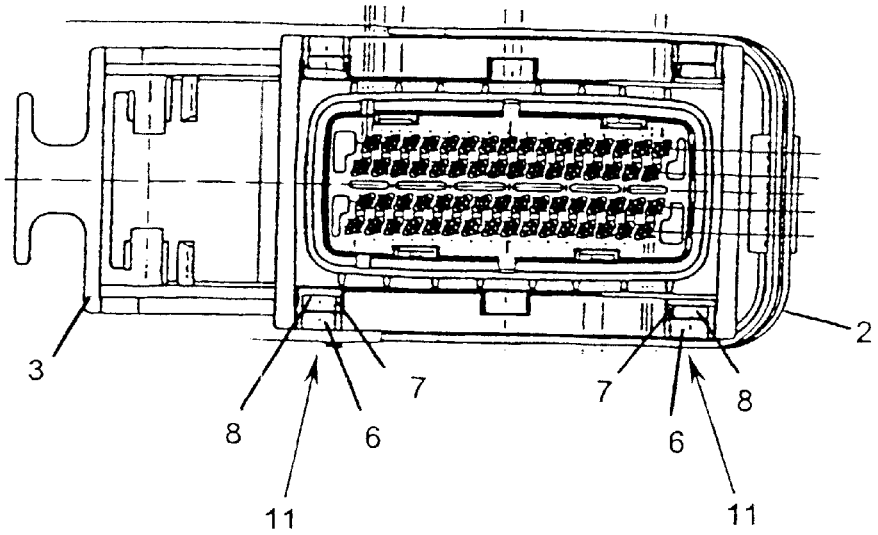
FIG. 2 shows a bottom view of the first plug part according to FIG. 1.
Figure 3:
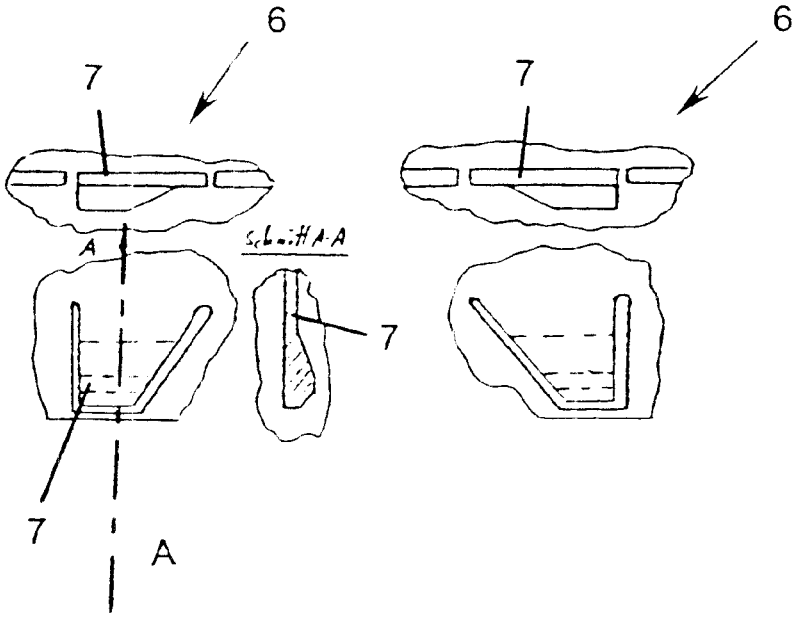
FIG. 3 shows a schematic diagram of the latching elements according to FIG. 1 in several views.

As also shown in greater detail in FIGS. 2 and 3, one latching element 6 has a latching hook 7 hinge-connected to the plug housing, its free end designed like a hook facing inward into plug housing 2. Latching element 6 is preferably designed in one piece with plug housing 2.

In the position of locking slide 3 illustrated in FIG. 1, latching hook 7 engages in recesses 8 provided there, so that latching is established between latching element 6 and locking slide 3 in this position. This guarantees that locking slide 3 will not fall out of plug housing 2 but also that it will not unintentionally assume its end position.

Figure 4:
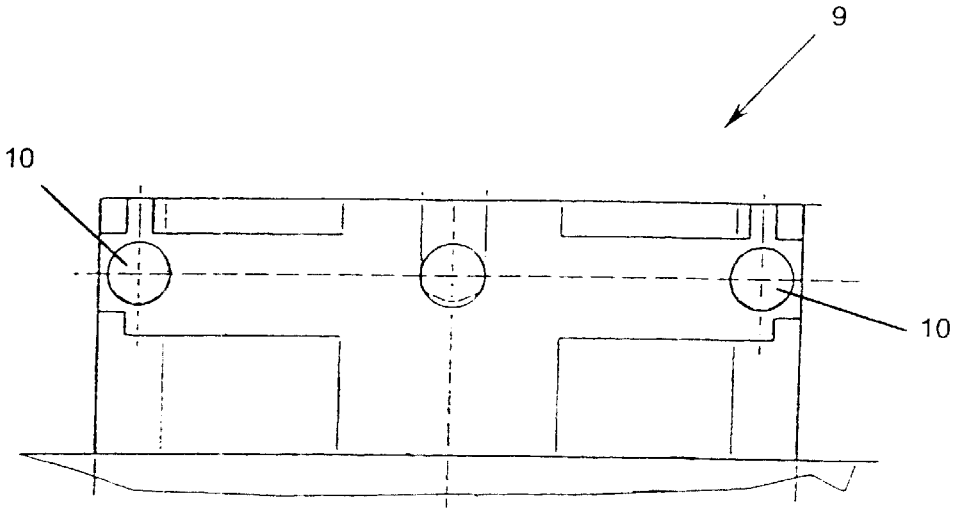
FIG. 4 shows a schematic diagram of the other plug element having the latching pins that work together with the latching elements according to FIGS. 1 and 3.
Figure 5:
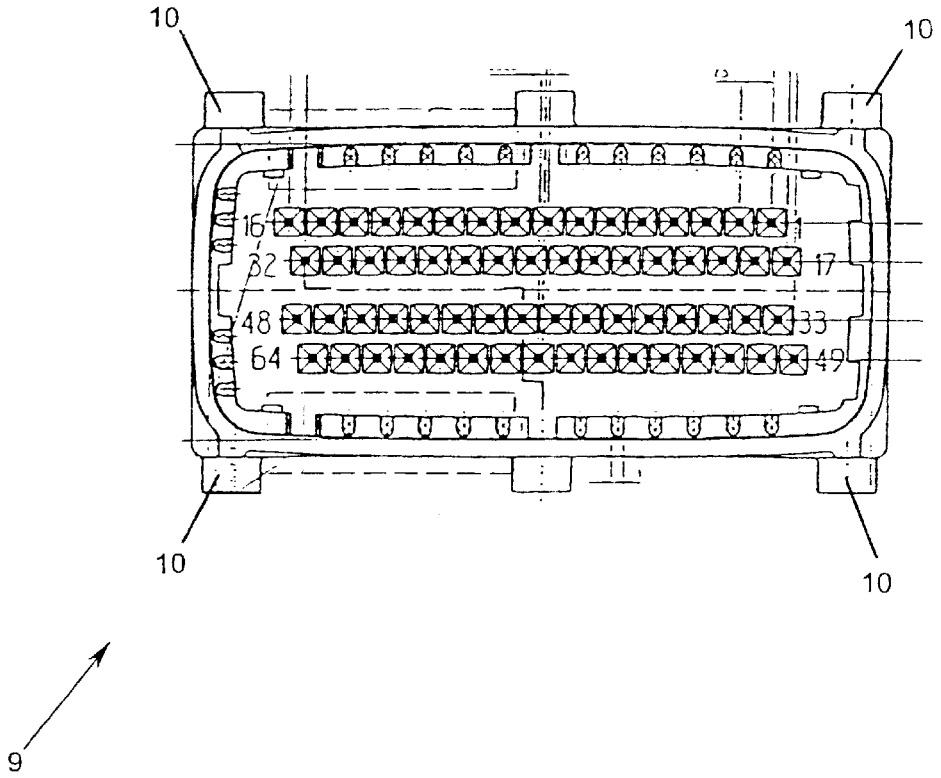
FIG. 5 shows a bottom view of the other plug element according to FIG. 3.
Figure 6:
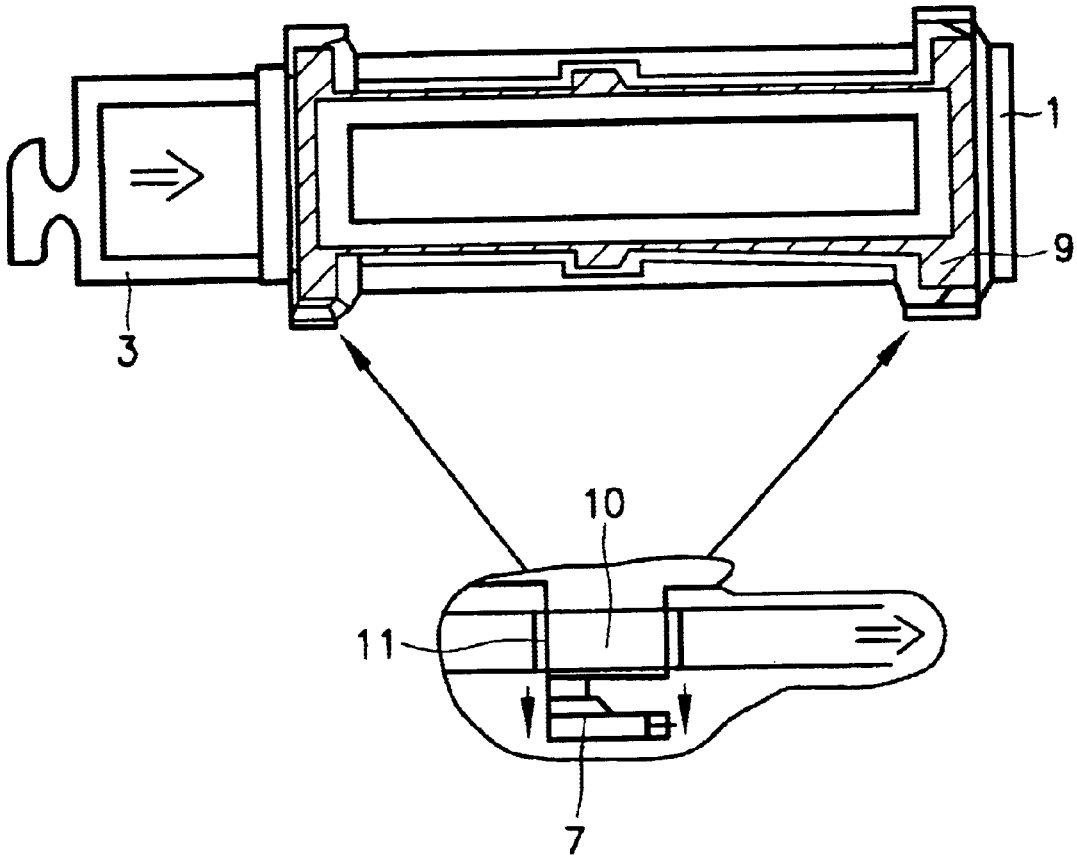
FIG. 6 shows the release of the locking slide from the latching elements by the latching pins as the first plug part and the other plug part are connected to each other.

As seen in FIG. 6, when first plug part 1 according to FIGS. 1 through 3 is connected to other plug part 9 illustrated in FIG. 4, pins 10 arranged on the outside of the housing of other plug part 9 engage in recesses 11 provided in plug part 1 (FIG. 2), and during the remaining connection operation, pins 10 disengage latching hooks 7. After the connection operation is concluded, locking slide 3 can be pushed into its end position, and locking claw 4, if present, can also be swivelled into its end position.

What is claimed is:

1. An electric plug-and-socket connection comprising:

a first plug part;

a locking slide movable from an initial position into an end position;

a second plug part for receiving the first plug part to establish a connection; and latching elements situated on the first plug part, the latching elements latching with the locking slide in the initial position of the locking slide, the latching elements releasing the locking slide after the first plug part is connected to the second plug part.

2. The connection according to claim 1, wherein the first plug part is a cable harness plug.

3. The connection according to claim 1, further comprising a locking claw situated on the first plug part, the locking claw movable from an initial position into an end position, the locking claw cooperating with the locking slide such that the locking claw can be moved into the end position of the locking claw only when the locking slide is in the end position of the locking slide.

4. The connection according to claim 1, further comprising pins cooperating with the latching elements, the pins being situated on a side of the second plug part, the first plug part including a plug housing, the latching elements being situated on a side of the plug housing.

5. The connection according to claim 1, wherein the latching elements include latching hooks hinge-connected on one end, each of the latching hooks being situated such that the latching hook engages in a recess in the locking slide.

6. The connection according to claim 1, wherein:

each one of the latching elements, when latched to the locking slide, prevents the locking slide from moving in a forward direction and from moving in a backward direction with respect to the first plug part.

* * * * *